United States Patent [19]

Bareis et al.

[11] 3,935,770

[45] Feb. 3, 1976

[54] PUNCHING PRESS WITH TOOL EXCHANGING MEANS

[75] Inventors: Alfred Bareis, Uhingen; Karl Dangelmaier, Goppingen-Holzheim; Joachim Von Wlassaty, Albershausen, all of Germany

[73] Assignee: L. Schuler GmbH, Germany

[22] Filed: Mar. 15, 1974

[21] Appl. No.: 451,674

[30] Foreign Application Priority Data

Mar. 15, 1973 Germany ..... 2312898

[52] U.S. Cl. ..... 83/95; 83/97; 83/158; 83/563

[51] Int. Cl.[2] ..... B26D 7/06

[58] Field of Search ..... 83/27, 86, 88, 89, 90, 83/91, 94, 95, 97, 155, 158, 563, 618, 83/687, 698

[56] References Cited

UNITED STATES PATENTS

| | | | |
|---|---|---|---|
| 2,604,167 | 7/1952 | Oliver | 83/86 |
| 3,533,319 | 10/1970 | Addis | 83/27 |

FOREIGN PATENTS OR APPLICATIONS

| | | | |
|---|---|---|---|
| 2,121,578 | 8/1972 | France | 83/95 |
| 1,160,889 | 8/1969 | United Kingdom | 83/563 |

*Primary Examiner*—J. M. Meister
*Assistant Examiner*—Fred A. Silverberg
*Attorney, Agent, or Firm*—Craig & Antonelli

[57] ABSTRACT

Punching press apparatus including an exchangeable tool set having upper and lower punching tools movable toward one another by a pressing ram to punch parts from sheet metal material. A stacking duct extends vertically downwardly from thepunching dies to accommodate a plurality of the punched out parts, which parts are then conveyed by endless magnetic conveyor belts arranged below the stacking duct, to remote part stacking mandrels and the like. In order to accommodate exchange of the punching tools without disconnection or emptying of the stacking ducts, the stacking ducts extend downardly to a position spaced upwardly of a press table supporting a toolholding plate, which toolholding plate supports the lower punching tool. The stacking ducts are formed as inserts in the toolholding plate so that a very simple exchange of the punching tools and toolholding plates can be effected by lateral movement of the units including the toolholding plate and punching tool out of the press ram working area. In preferred embodiments, air cushion means are provided between the press table and the toolholding plate to facilitate easy lateral movement for tool exchange operations. The conveyor belts are arranged in grooves in the press table so that they do not interfere with the exchanging operation.

24 Claims, 3 Drawing Figures

PUNCHING PRESS WITH TOOL EXCHANGING MEANS

BACKGROUND AND SUMMARY OF THE INVENTION

This invention relates to a punching press including exchangeable tool sets having upper and lower punching tools wherein the parts punched out by the punching dies of the tools are discharged through a stacking duct in the lower punching tool. The punching press of the present invention may advantageously be utilized for punching out sheet-metal parts for electrical machinery and the like.

A substantial disadvantage of previously contemplated punching presses of this type is that an exchanging of the punching tools (blanking dies) is very cumbersome and time-consuming due to the fact that basket- or cage-type stacking ducts through which the cut-out metal sheets were discharged from the area underneath the punching tool were extended through an underlying press table or workholding plate and were attached in the zone of the underside of the tool. Consequently these stacking ducts had to be detached and lowered before each exchange of punching tools or dies. Prior arrangements also required removal of a portion of the metal sheets present in the ducts from the tool zone before the tool could be removed or disassembled.

The present invention contemplates providing punching apparatus which avoids the above-mentioned disadvantages by configuring and constructing the stacking ducts so that they need not be detached and removed or emptied during exchange of punching tool sets.

An important feature of the present invention is the spacing of the stacking duct structure from a conveying system for removal of the punched out parts from the stacking ducts and the spacing of the stacking duct structure from the press table surface of the press which supports a toolholding plate and the lower punching tool. In a preferred embodiment of the invention, the conveying system includes magnetic conveyor belts extending in grooves formed in the press table and extending from adjacent the bottom of the stacking ducts to remote part storage locations.

With the arrangement of the present invention, the entire toolholding plate with stacking inserts forming the stacking ducts located therein, including the punched out parts collected in the stacking ducts and the lower punching tool, can be moved as a unit laterally out of the press. For moving this unit out of the press, hydraulically liftable rollers or mechanical displacing means including a rope, a chain, or a rack-and-pinion gear, or similar devices can be utilized according to the present invention. However, a particularly preferred embodiment of the present invention uses air cushion means for vertically supporting the unit as it is moved laterally along the press table and bracket means connected thereto.

In preferred embodiments, the units, including toolholding plates, punching tools, and stacking inserts, are pushed out of the press at the front or at the rear thereof on fixed or movable supporting brackets and, at that point (located remotely laterally of the press ram travel path and press table), can rapidly be exchanged for a new punching tool or set of punching tools with the aid of a lifting means.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
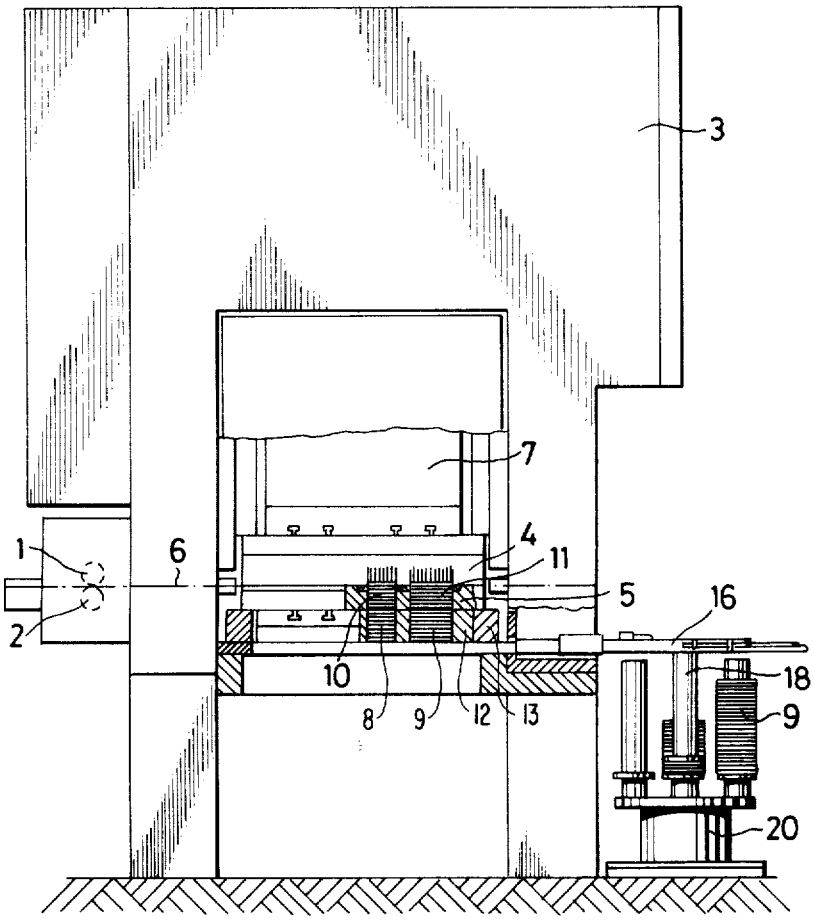
FIG. 1 is a part sectional schematic front view, taken along line I—I of FIG. 3, of a punching press constructed in accordance with a preferred embodiment of the present invention.

In the drawings, like reference numerals are used throughout the various views to depict like structures.

Feed rollers 1, 2 feed a sheet-metal strip 6 between upper punching tool 4 and lower punching tool 5 of press 3. Pressing ram 7 effects punching out of parts or blanks 8, 9 from strip 6 upon each stroke of the ram 7. Since means for feeding and discharging strip 6, as well as means for driving ram 7, of conventional construction can be used with the present invention, further details of same are not included so as not to obscure the invention.

Blanks 8, 9 are passed through respective separate stacking ducts 10, 11 through the lower punching tool 5. These two stacking ducts 10, 11 extend from die portion 23 of lower tool 5 through an insert 12 in the table top or toolholder plate 13 and terminate shortly above the bottom surface of plate 13, which bottom surface of plate 13 rests on the top surface of press table 14. In order to separate the individual sheet-metal parts, the insert 12 is preferably tapered in its cross section toward the the exit area, or spreading elements schematically depicted in FIG. 1 are installed in the insert 12.

Figure 2:
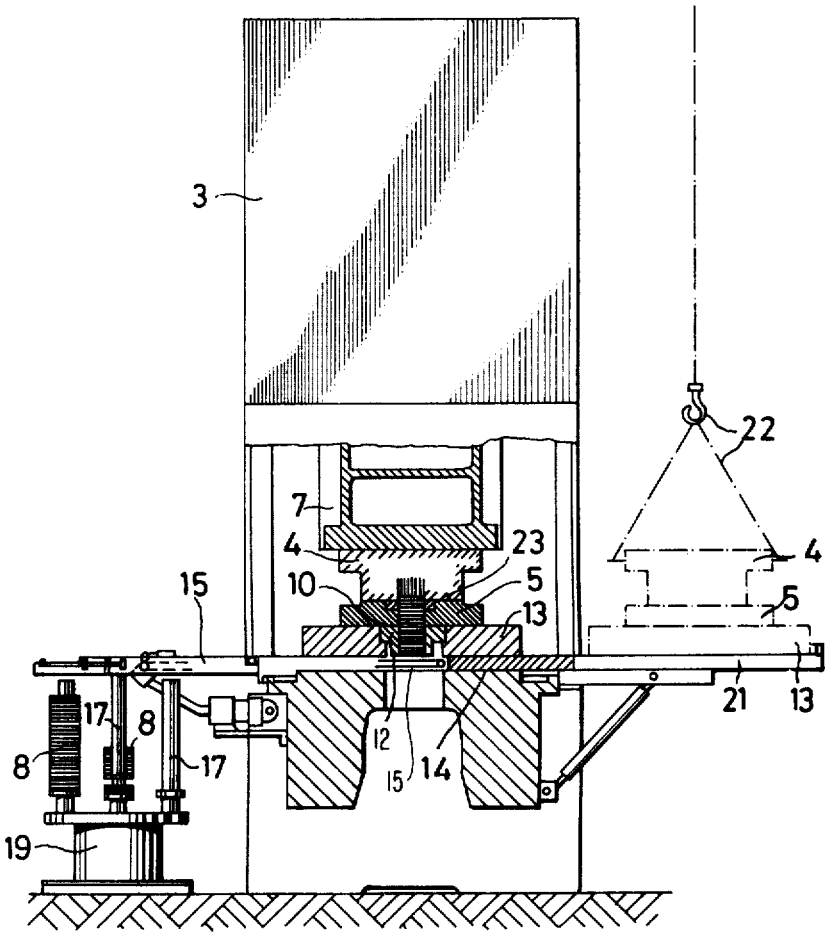
FIG. 2 is a part sectional schematic lateral view, taken along line II—II of FIG. 3.
Figure 3:
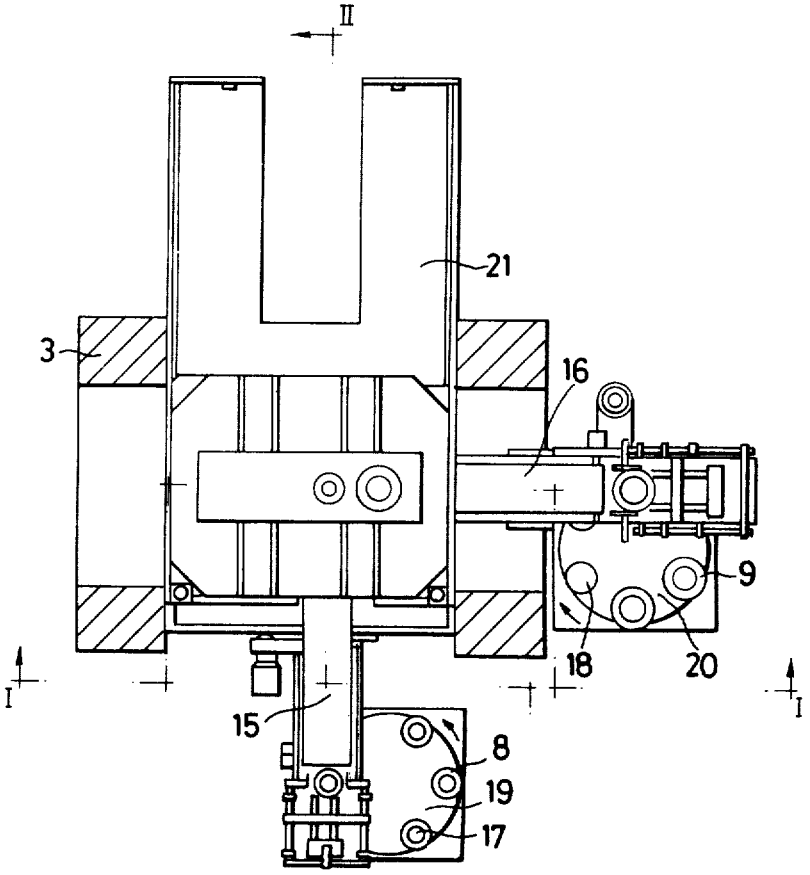
FIG. 3 is a schematic top view of the punching press of FIGS. 1 and 2.

The individual sheet-metal parts 8, 9, which exit from the bottom of the respective stacking ducts 10, 11, fall onto conveyor belts 15, 16 extending at a right angle to each other. These belts 15, 16 are controlled with respect to their speed so that the sheet-metal parts 8, 9 are arranged so that they partially overlap one another and pass to respective rotatable stacking stations 19, 20 equipped with several mandrels 17, 18. Since the stacking ducts 10, 11 terminate shortly above the bottom surface of the toolholder plate 13 and since the conveyor belts 15, 16 are disposed in indentations or grooves of the press table 14 and/or in a recess of the table top 13, the entire unit including punching tools 4, 5 can be extended, together with the toolholder plate 13, laterally out of the press area on brackets 21. As can be seen from FIG. 2, this unit can then be easily exchanged with the aid of a lifting means 22. The extension (lateral outward movement) of the punching tools is facilitated by an air cushion produced by inserts in the table 14 and the brackets 21. Hydraulic piston cylinder mechanisms and rack-and-pinion gear mechanisms are also contemplated by the present invention for laterally moving the punching tool unit out of the press area onto brackets 21. Details of such mechanisms are not included herein, since one skilled in the art, given the present disclosure, will be able to modify known devices to effect the simple lateral mechanical movement and exchange of punching tool units.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Punching press apparatus comprising:

an exchangeable tool set having first and second punching tools, pressing ram means for pressing said first and second tools toward one another to punch parts from sheet material interposed between said first and second tools, a press table supporting said second tool, at least one stacking duct for stackingly accommodating a plurality of said parts punched out by said tools, and tool exchanging means including movement accommodating means for accommodating movement of said second tool relative to said press table in a direction transverse to the stacking direction in which said at least one stacking duct extends, wherein each of said at least one stacking ducts extends through said second tool from respective positions where said parts are punched out and terminates on the side of the second tool which faces said press table at a spacing from said press table such that said second tool can be moved with respect to said press table in said transverse direction without emptying said at least one stacking duct and without separation of said at least one stacking duct from said second tool, each of said at least one stacking ducts being carried in their entirety with and movable with said second tool in said transverse direction.

2. Apparatus according to claim 1, wherein the end of each of said stacking ducts disposed closest to said press table includes spreading elements for separating individual parts.

3. Apparatus according to claim 1, wherein said tools are constructed for punching out sheet metal parts.

4. Apparatus according to claim 1, wherein two of said stacking ducts are provided for accommodating parts punched out respectively by two spaced sets of cooperating dies on said tools.

5. Apparatus according to claim 4, wherein separate grooves are provided in said press table which communicate with respective part discharge ends of said ducts, wherein conveyor belt means extend in said grooves for conveying parts from said ducts to positions spaced from said press table, and wherein said grooves and conveyor belt means extend at an angle with respect to one another.

6. Apparatus according to claim 1, wherein said movement accommodating means includes air cushion means for supporting said second tool with respect to said press table and guide bracket means for supporting and guiding said second tool as it is moved laterally of said press table.

7. Apparatus according to claim 6, wherein said first tool is detachably connected to said pressing ram means such that said first tool is movable with said second tool laterally of said press table.

8. Apparatus according to claim 1, wherein a toolholding plate is disposed between said press table and said second tool, and wherein said movement accommodating means includes means accommodating transverse movement of said toolholding plate together with said second tool.

9. Apparatus according to claim 8, wherein said first tool is an upper tool and said second tool is a lower tool, and wherein each of said at least one stacking ducts extend vertically downwardly from die surfaces of said second tool which cooperate with said first tool to punch out said parts.

10. Apparatus according to claim 9, wherein said movement accommodating means includes air cushion means for supporting said toolholding plate, together with said second tool supported on said toolholding plate, in the vertical direction with respect to said press table, and guide bracket means for supporting and guiding said toolholding plate and second tool as they are moved horizontally away from said press table.

11. Apparatus according to claim 10, wherein said first tool is detachably connected to said pressing ram means such that said first tool is movable with said second tool and toolholding plate laterally of said press table.

12. Apparatus according to claim 9, wherein conveying means are provided for conveying said parts away from the bottom end of each of said at least one stacking ducts to positions spaced from said press table.

13. Apparatus according to claim 12, wherein said conveying means extend transversely of said stacking direction in groove means formed in at least one of said press table and toolholding plate.

14. Apparatus according to claim 13, wherein spreading elements are disposed in the lower zone of each of said at least one stacking ducts for separating individual parts being supplied to the conveying means.

15. Apparatus according to claim 13, wherein said conveying means includes conveyor belt means extending in said groove means, and wherein said groove means includes an upwardly open groove in said press table within which said conveyor belt means is disposed at a position below the top surface of the press table.

16. Apparatus according to claim 15, wherein two of said stacking ducts are provided for accommodating parts punched out respectively by two spaced sets of cooperating dies on said tools.

17. Apparatus according to claim 16, wherein said groove means includes separate grooves for respective separate conveyor belt means extending one each from said respective stacking ducts, said separate grooves extending at an angle to one another to respective different sides of the press table.

18. Apparatus according to claim 13, wherein said conveying means includes endless conveyor belt means extending in said groove means.

19. Apparatus according to claim 18, wherein said movement accommodating means includes air cushion means for supporting said toolholding plate, together with said second tool supported on said toolholding plate, in the vertical direction with respect to said press table, and guide bracket means for supporting and guiding said toolholding plate and second tool as they are moved horizontally away from said press table.

20. Apparatus according to claim 19, wherein spreading elements are disposed in the lower zone of each of said at least one stacking ducts for separating individual parts being supplied to the conveying means.

21. Apparatus according to claim 19, wherein said tools are constructed for punching out sheet metal parts, and wherein said endless conveyor belt means are magnetic.

22. Apparatus according to claim 21, wherein two of said stacking ducts are provided for accommodating parts punched out respectively by two spaced sets of cooperating dies on said tools.

23. Apparatus according to claim 19, wherein said groove means are formed in said press table below the bottom surface of said toolholding plate and the top surface of said press table so as to facilitate horizontal movement of said toolholding plate.

24. Apparatus according to claim 23, wherein each of said at least one ducts is formed at least in part by an insert of said toolholding plate disposed below said second tool.

* * * * *